US007900962B2

(12) United States Patent
Lagsdin

(10) Patent No.: US 7,900,962 B2
(45) Date of Patent: Mar. 8, 2011

(54) STABILIZER PAD FOR VEHICLES

(76) Inventor: Andry Lagsdin, Hanover, MA (US)

( * ) Notice: Subject to any disclaimer, the term of this patent is extended or adjusted under 35 U.S.C. 154(b) by 275 days.

(21) Appl. No.: 11/726,226

(22) Filed: Mar. 21, 2007

(65) Prior Publication Data

US 2008/0122212 A1 May 29, 2008

Related U.S. Application Data

(60) Provisional application No. 60/861,218, filed on Nov. 27, 2006.

(51) Int. Cl.
*B60S 9/02* (2006.01)

(52) U.S. Cl. ..... 280/763.1; 280/764.1

(58) Field of Classification Search ..... 280/763.1, 280/764.1; 411/396, 398, 400, 401, 998; 248/633, 678, 677, 188.9, 188.8, 346.1, 345.01
See application file for complete search history.

(56) References Cited

U.S. PATENT DOCUMENTS 1,973,226 A 9/1934 Rose et al.
2,277,939 A * 3/1942 Thalhammer ..... 248/188.9
3,219,362 A 11/1965 Epstein
3,244,301 A 4/1966 Vaughan
3,310,181 A 3/1967 William
3,495,727 A 2/1970 Long
3,642,242 A 2/1972 Danekas
3,721,458 A * 3/1973 Mitchell ..... 280/764.1
3,754,777 A 8/1973 Riggs et al.
3,758,154 A 9/1973 Kitaguchi
3,831,774 A 8/1974 Moore
3,881,692 A 5/1975 Clarke
3,897,079 A 7/1975 MacKenzie et al.
3,913,942 A * 10/1975 MacKenzie et al. ..... 280/764.1
3,924,876 A 12/1975 Vaillant et al.
3,930,668 A 1/1976 Schuerman et al.
3,945,666 A 3/1976 Fritsch
3,976,306 A 8/1976 Nault
3,990,714 A 11/1976 Hornagold
3,998,470 A 12/1976 Houston
4,023,828 A 5/1977 MacKenzie et al.
4,039,206 A 8/1977 Nault
4,066,234 A 1/1978 Nycum
4,073,454 A 2/1978 Sauber
4,201,137 A 5/1980 Lagsdin
4,204,714 A 5/1980 Jacobson et al.
4,266,809 A 5/1981 Wuerflein
4,397,479 A 8/1983 Schmidt
4,421,290 A * 12/1983 Frank ..... 248/558
4,473,239 A 9/1984 Smart
4,515,520 A 5/1985 Parquet et al.

(Continued)

FOREIGN PATENT DOCUMENTS

CA 492912 5/1953

(Continued)

*Primary Examiner* — J. Allen Shriver, II
*Assistant Examiner* — John D Walters
(74) *Attorney, Agent, or Firm* — David M. Driscoll, Esq.

(57) ABSTRACT

A stabilizer pad structure including a weldment formed of a metal plate material that is arranged in a generally U-shaped form including side legs and a connecting base and a resilient pad mounted to the weldment. Means are provided for forming pockets in the legs of the weldment for receiving the resilient pad. The weldment also includes a pair of grouser flanges on the opposed side of the pocket and with each grouser flange overlying the footprint of the resilient pad.

4 Claims, 4 Drawing Sheets

U.S. PATENT DOCUMENTS

| | | | | | |
|---|---|---|---|---|---|
| 4,531,883 | A | | 7/1985 | Arnold | |
| 4,546,996 | A | | 10/1985 | Hanson | |
| 4,619,369 | A | | 10/1986 | Mertens | |
| 4,761,021 | A | * | 8/1988 | Lagsdin | 280/764.1 |
| 4,860,539 | A | | 8/1989 | Parrett et al. | |
| 4,889,362 | A | * | 12/1989 | Lagsdin | 280/763.1 |
| 5,011,184 | A | | 4/1991 | Loudon | |
| 5,015,008 | A | | 5/1991 | Schupback | |
| 5,050,904 | A | | 9/1991 | Lagsdin | |
| 5,051,057 | A | | 9/1991 | Kremer | |
| 5,054,812 | A | | 10/1991 | Lagsdin | |
| 5,154,255 | A | | 10/1992 | Kista et al. | |
| 5,310,217 | A | | 5/1994 | Paskey et al. | |
| 5,335,898 | A | * | 8/1994 | Johnson | 269/41 |
| 5,338,255 | A | | 8/1994 | Akehurst | |
| 5,466,004 | A | | 11/1995 | Lagsdin | |
| 5,488,788 | A | | 2/1996 | Durbin | |
| 5,547,220 | A | * | 8/1996 | Lagsdin | 280/763.1 |
| 5,564,871 | A | | 10/1996 | Lagsdin | |
| 5,667,245 | A | | 9/1997 | Lagsdin | |
| 5,730,455 | A | | 3/1998 | Varnum, Sr. et al. | |
| 5,957,496 | A | | 9/1999 | Lagsdin | |
| 5,992,883 | A | * | 11/1999 | Lagsdin | 280/763.1 |
| 6,109,650 | A | | 8/2000 | Lagsdin | |
| 6,270,119 | B1 | | 8/2001 | Lagsdin | |
| 6,422,603 | B2 | | 7/2002 | Lagsdin | |
| 6,471,246 | B1 | | 10/2002 | Lagsdin | |
| 6,634,672 | B1 | | 10/2003 | Lagsdin | |
| 6,726,246 | B2 | | 4/2004 | Lagsdin | |
| 6,986,530 | B2 | | 1/2006 | Lagsdin | |
| 7,040,659 | B2 | | 5/2006 | Lagsdin | |
| 7,172,216 | B1 | * | 2/2007 | Lagsdin | 280/763.1 |

FOREIGN PATENT DOCUMENTS

| | | |
|---|---|---|
| CA | 1029715 | 4/1978 |
| CA | 1036148 | 8/1978 |

* cited by examiner

STABILIZER PAD FOR VEHICLES

RELATED APPLICATION

Priority for this application is hereby claimed under 35 U.S.C. §119(e) to commonly owned and co-pending U.S. Provisional Patent Application No. 60/861,218 which was filed on Nov. 27, 2006. The content of all of the aforementioned application is hereby incorporated by reference herein in its entirety.

FIELD OF THE INVENTION

The present invention relates in general to stabilizer pads for vehicles, and more particularly to stabilizer pads that are used with backhoe-type vehicles for supporting stabilizer arms of the vehicle.

BACKGROUND OF THE INVENTION

Various types of stabilizer pads are described in, for example, U.S. Pat. Nos. 5,992,883 and 6,270,119. These pad structures have a generally flanged first surface for engagement with a soft irregular ground surface such as gravel and have a resilient opposite surface for engagement with a smooth ground surface such as concrete or asphalt. With the increased cost of commodities it is desirable to be able to make a pad product that is sufficiently durable and yet can be made lighter in weight.

It is thus an object of the present invention to provide an improved stabilizer pad arrangement that can preferably be constructed lighter in weight and yet is just as durable is past structures.

Another object of the present invention is to provide an improved stabilizer pad construction that is more stable in its function whether on the resilient pad side or the grouser side.

Still another object of the present invention is to provide an improved stabilizer pad construction that can be manufactured more inexpensively and with fewer production steps.

SUMMARY OF THE INVENTION

To accomplish the foregoing and other objects, features and advantages of the present invention there is provided a stabilizer pad structure comprising: a weldment formed of a metal plate material that is arranged in a generally U-shaped form including side legs and a connecting base; a resilient pad mounted to said weldment; and means forming pockets in the legs of the weldment for receiving the resilient pad.

In accordance with other aspects of the present invention the pockets may be formed by bending the plate material on either side of each leg; the resilient pad may be a laminated pad; a clamp bar and securing bolts may be provided for securing the resilient pad in the pocket; the weldment may also include a pair of grouser flanges on the opposed side of the pocket and with each grouser flange overlying the footprint of the resilient pad; each grouser flange may be disposed within the center 80% of the resilient pad; a clamp bar may be disposed between the resilient pad and one of the side legs and at least one securing bolt; the clamp bar may have a threaded hole for receiving a threaded section of the bolt; the bolt may have an end post received in a hole in the leg; an L-shaped bracket may be provided having one arm for contacting one of said legs and another arm for contacting the resilient pad, and at least one securing bolt.

In accordance with another feature of the present invention there is provided a stabilizer pad structure comprising: a weldment formed of a metal plate material that is arranged in a generally U-shaped form including side legs and a connecting base; and a resilient pad mounted to the weldment; wherein the weldment also includes a pair of grouser flanges on the opposed side of the pocket and with each grouser flange overlying the footprint of the resilient pad.

In accordance with other aspects of the present invention each grouser flange may be disposed within the center 80% of the resilient pad; means are provided forming pockets in the legs of the weldment for receiving the resilient pad; a clamp bar and securing bolts are provided for securing the resilient pad in the pocket.

In accordance with another feature of the present invention there is provided a method of constructing a stabilizer pad structure comprising the steps of: forming a blank that includes a pair of side legs connected by a base member with the blank being of generally U-shaped configuration; providing a pair of side wings on each leg; bending the side wings of both side legs to form respective side leg pockets; and attaching a pair of grouser flanges extending along respective side legs.

In accordance with other aspects of the present invention including securing a resilient pad in each of the formed pockets; wherein said side wings are bent in a first direction and the grouser flanges are attached so as to extend in a second direction that is substantially orthogonal to the first direction; including securing the resilient pad by means of one or more securing bolts; including providing a clamp bar between the resilient pad and bent leg or including providing an L-shaped clamp bracket between the resilient pad and bent leg.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
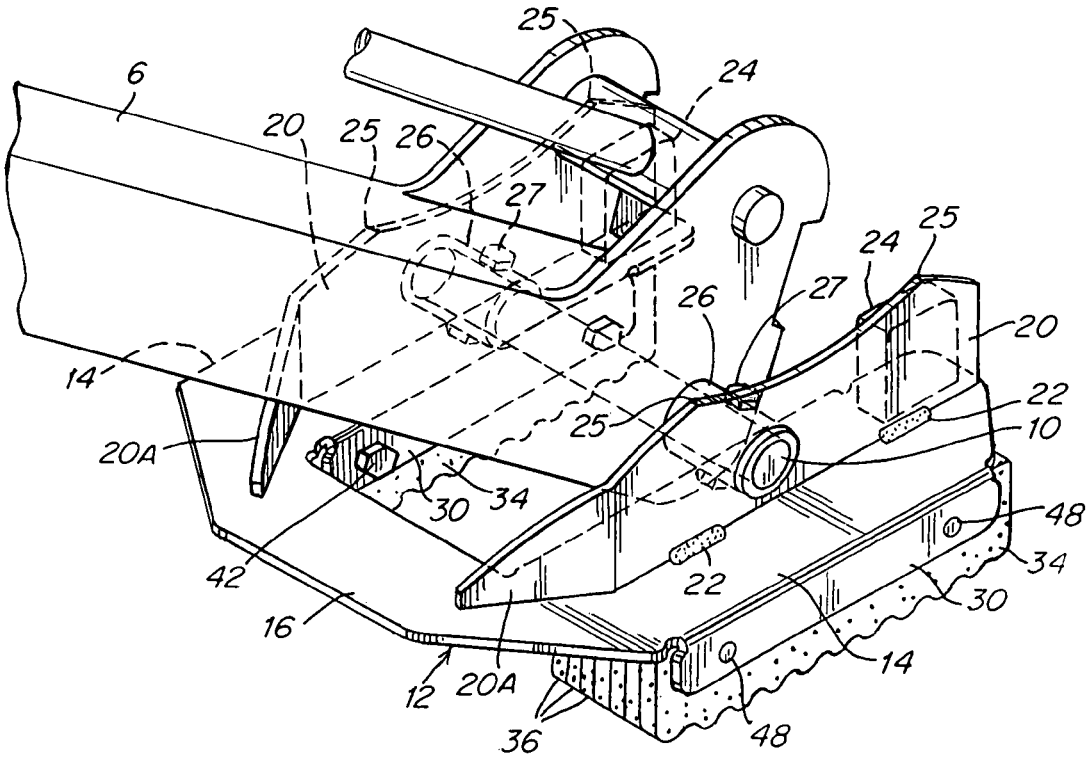
FIG. 1 is a perspective view of a preferred embodiment of the improved stabilizer pad of the present invention.

Reference is now made to the drawings for an illustration of the stabilizer pad of the present invention. The pad is comprised of a metal weldment that has a grouser on one side and mounts a pair of resilient pads on the other side. The basic weldment is of generally U-shape. The stabilizer pad is meant for support from a stabilizer arm 6 of earth moving equipment such as a backhoe. The weldment of the stabilizer pad is supported from the stabilizer arm 6 by means of a pin 10. FIG. 1 shows the pin 10. For a similar support stabilizer arm refer, for example, to my earlier U.S. Pat. No. 6,270,119 which is hereby incorporated by reference in its entirety.

Figure 2:
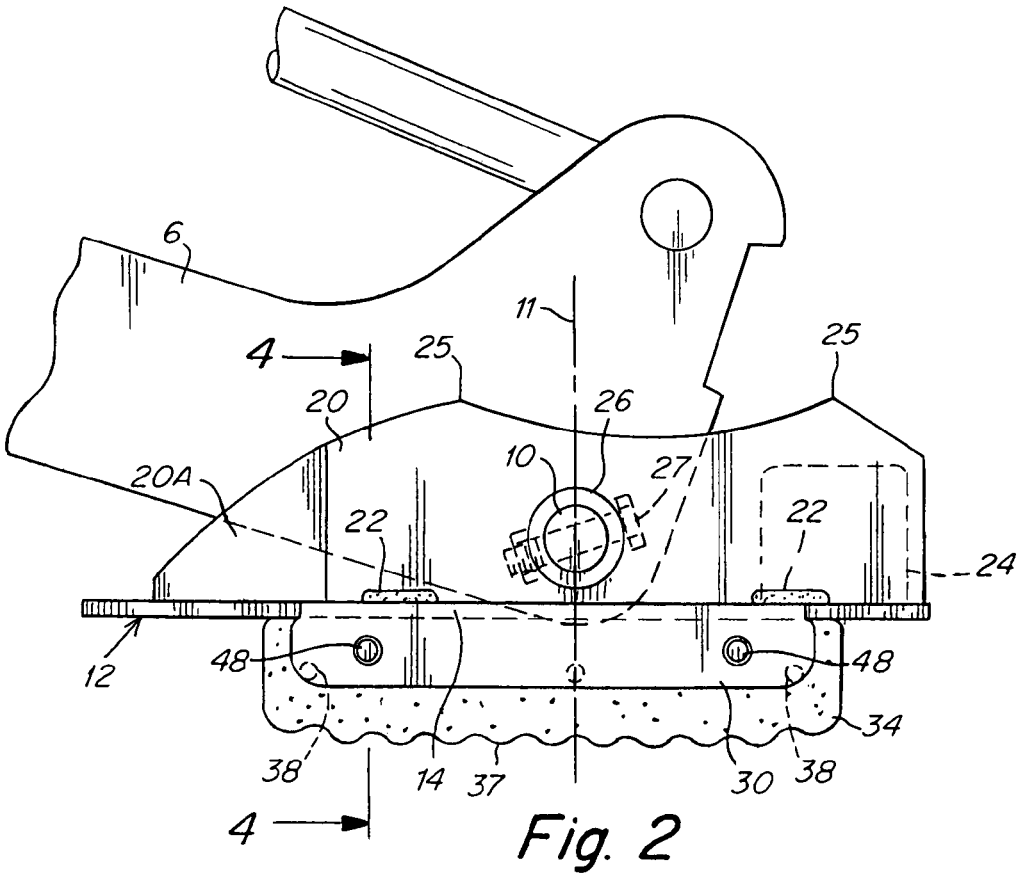
FIG. 2 is a right side elevation view of the stabilizer pad of FIG. 1.
Figure 3:
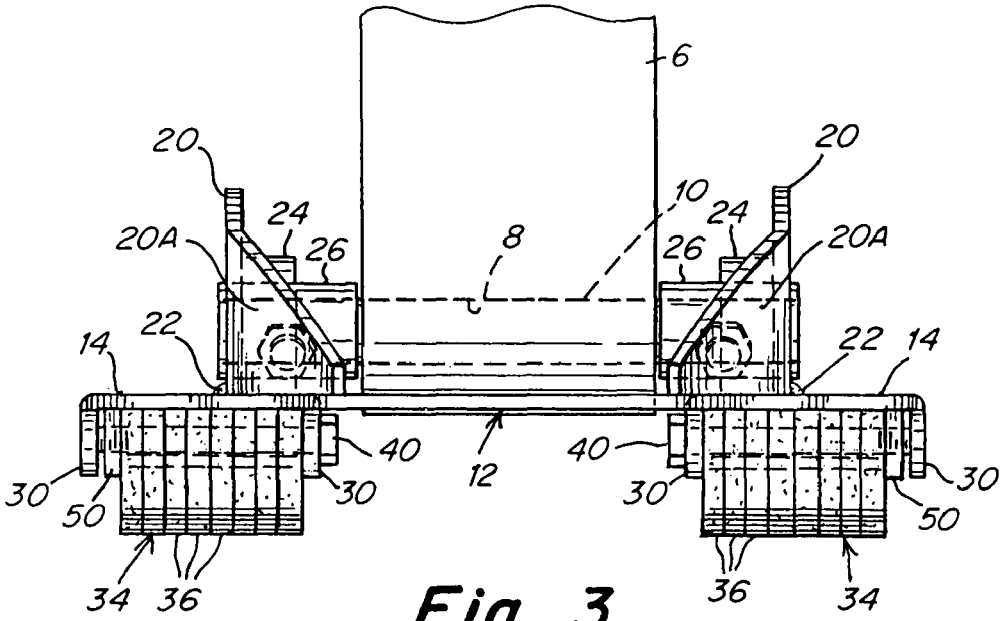
FIG. 3 is a front elevation view of the stabilizer pad of FIG. 1.

The stabilizer pad is constructed using a main plate member 12 that is generally of U-shape. The plate member 12 includes opposed legs 14 and contiguous base 16. Each of the legs 14 has attached thereto grouser flanges 20. Each of the grouser flanges is attached to the main plate by means of weld joints 22 only some of which are shown in FIG. 1. The grouser flanges 20 are disposed substantially orthogonal to the plane of the weldment plate. FIG. 1-3 also illustrate the counterweights 24 which may be attached to the respective grouser flanges 20 and/or the legs 14. Due to the arrangement of the grouser flanges relative to the plate member, the counterweights 24 are of relatively light weight, as is discussed in further detail hereinafter.

FIG. 1 also illustrates the pivot pin 10 which is attached to the flanges 20 at bushings 26. Each of the bushings 26 may be welded to their corresponding grouser flange 20. In accordance with the present invention the pin 10, rather than being free rotating in the bushings 26 is secured by a bolt 27 or the like. The bolt 27 may extend through holes 29 provided in the bushing 26 and the pin 10 and each bolt 27 is secured by means of an associated nut 28. The pin 10 also passes through the hole 8 inn the stabilizer arm 6. This securing between the pin 10 and the stabilizer pad weldment provides the proper force transfer. The pin 10 functions, not only to provide the rotation, but also force transfer, absorbing some of the force directly at the pin and thus not relying exclusively upon the weldment itself for load transfer.

Each of the grouser flanges 20 is provided with spaced grouser points 25. In this regard refer to the side view of FIG. 2 that shows the grouser points 25 one disposed on each side of the pin 10. More than two grouser points may also be provided associated with each of the grouser flanges 20.

Figure 4:
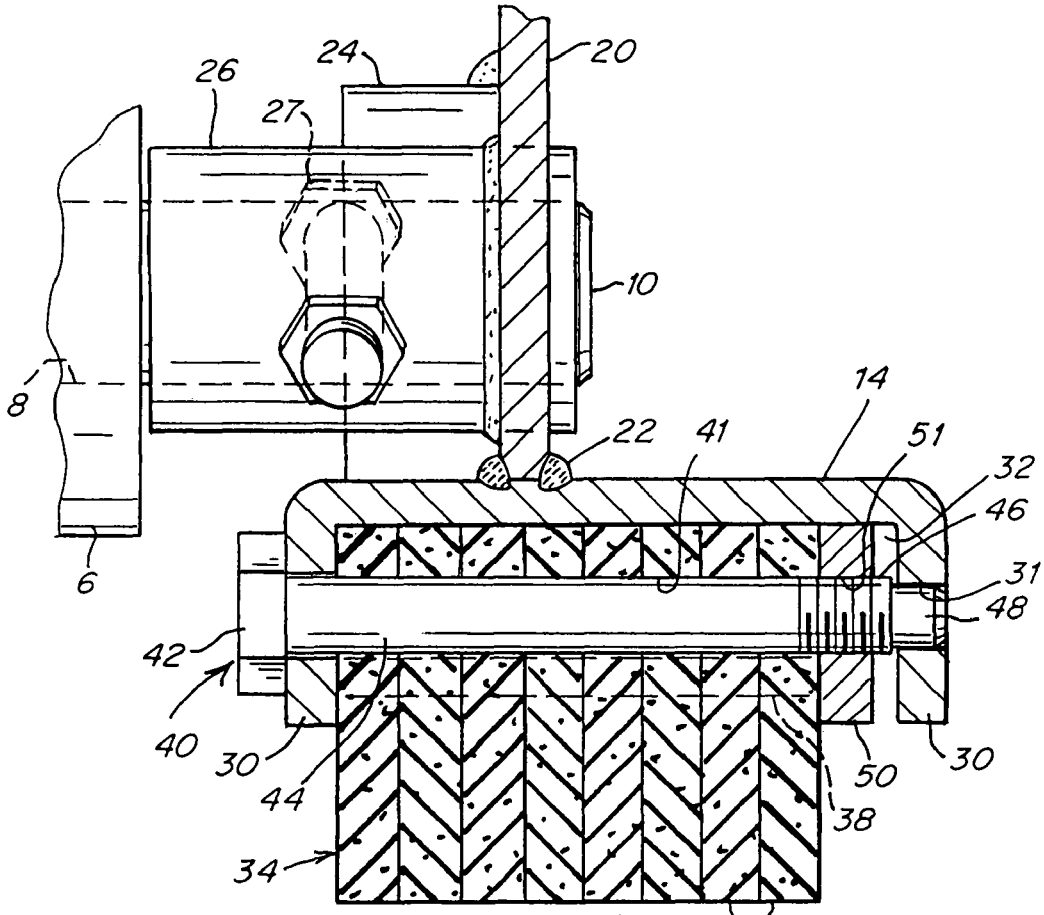
FIG. 4 is a fragmentary cross-sectional view as taken along line 4-4 of FIG. 2.
Figure 5:
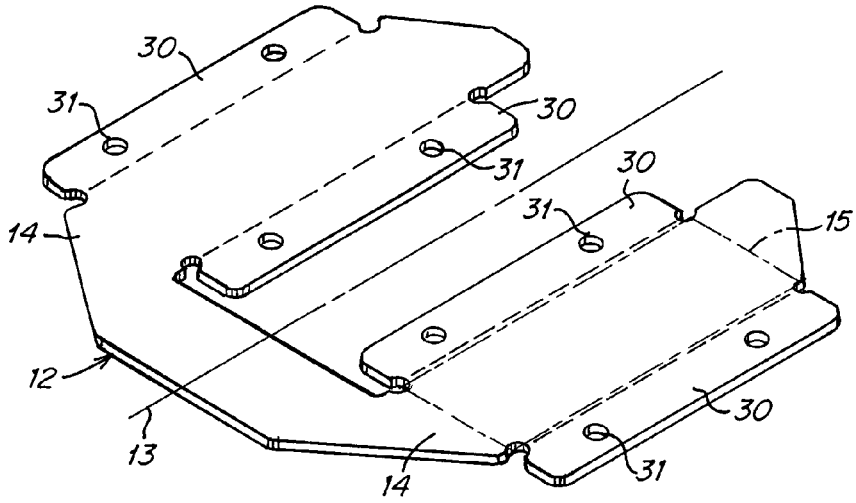
FIG. 5 is a perspective view of the pad blank that is used in constricting the pad of FIG. 1.
Figure 6:
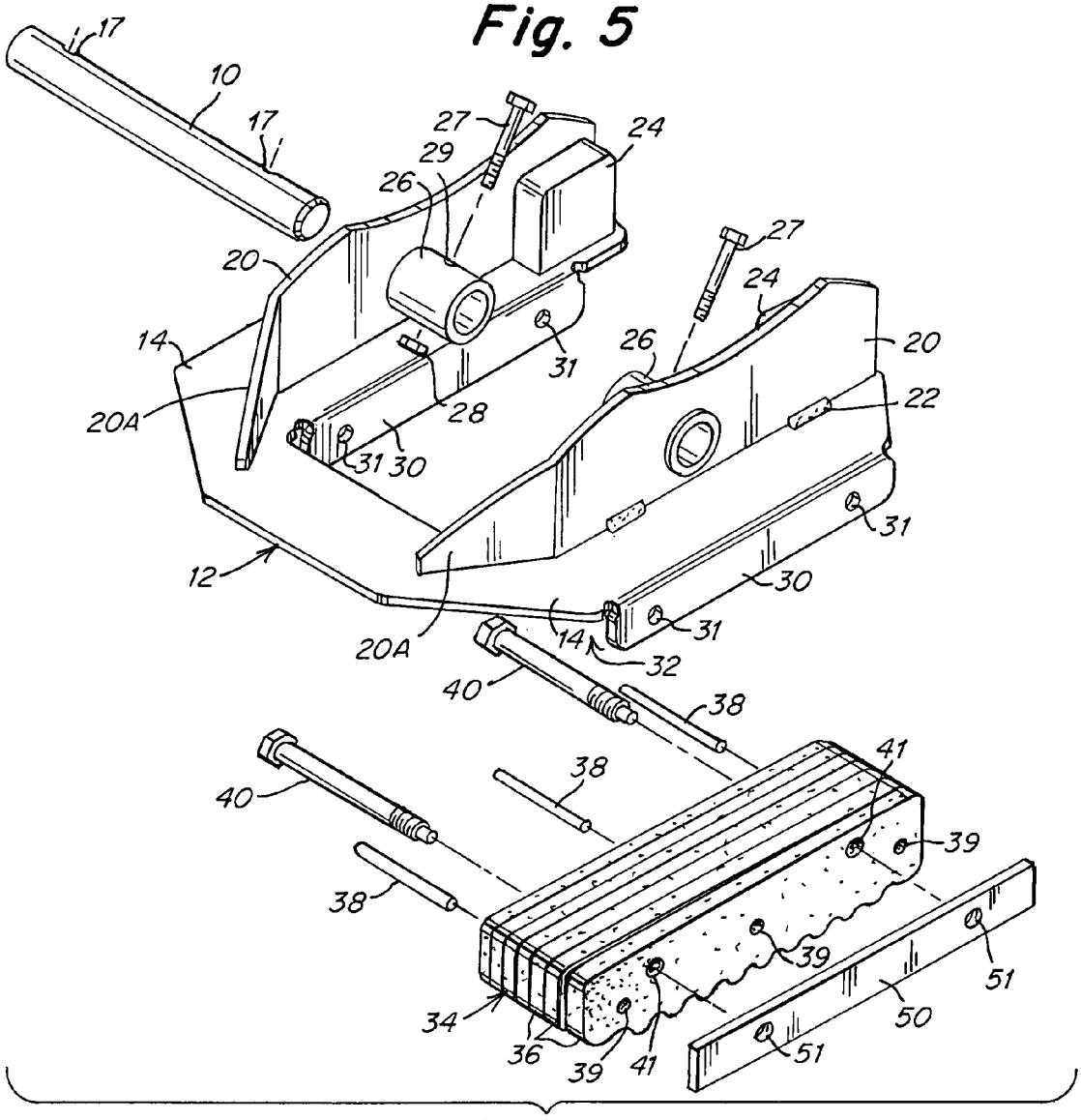
FIG. 6 is an exploded perspective view of the stabilizer pad of FIG. 1.
Figure 8:
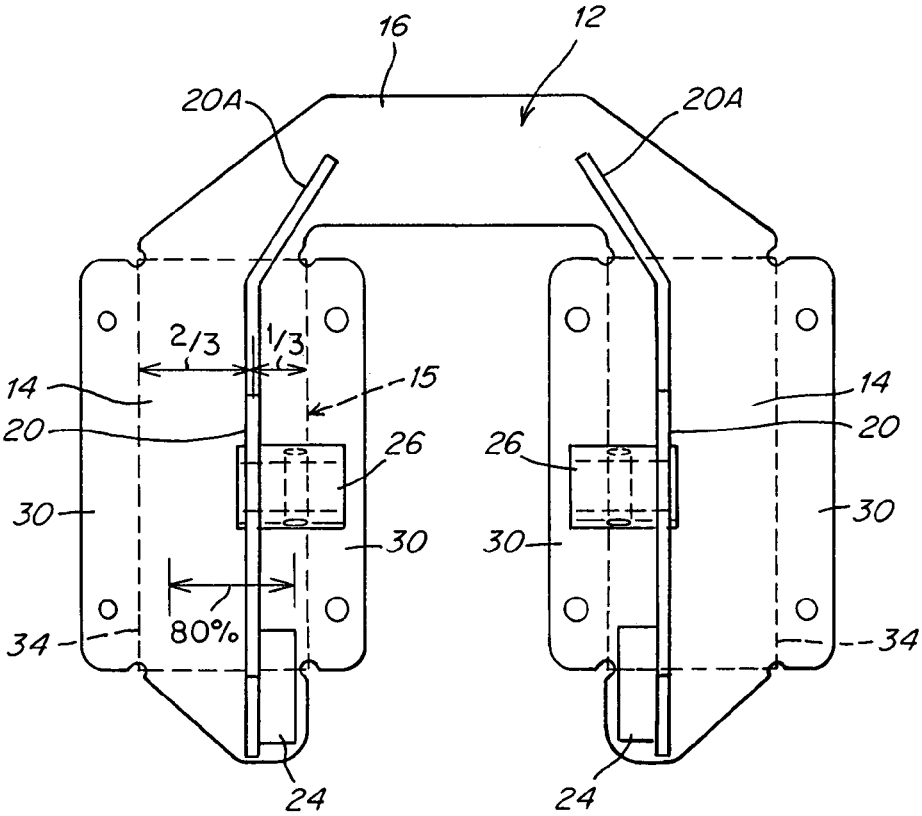
FIG. 8 is a plan view of the blank of FIG. 5 in relation to the grouser flanges.

FIGS. 5 and 8 are an illustration of the configuration of the plate member 12 at an initial step. This may be cut from a piece of plate steel by a well known process such as by means of a plasma cutting technique. The plate member 12 is preferably symmetric about the center line 13. After the plate member is cut into, the shape shown in FIG. 5, then a bending operation is provided so as to bend side portions 30 associated with each of the legs 14. These side portions are bent at a 90 degree angle and form the respective side walls 30 depicted in FIGS. 1 and 3. FIGS. 4 and 6 show how the sidewalls 30 form a pocket 32 for receiving the resilient pad 34. There is a resilient pad 34 associated with each of the pockets 32. Each pocket 32 has opposed sidewalls 30.

The resilient pad 34 may be a molded rubber pad but is preferably a laminated pad that is comprised of a series of laminated layers 36. These laminated layers 36 are preferably held together by a series of pins 38 that pass through holes 39. FIGS. 2 and 6 illustrate the configuration of each pad layer. Each of these pad layers preferably has a wave-like ground contact surface 37. As illustrated in FIG. 6, the laminated layers may be tied together by means of three force fit pins 38 that are forced into passages in each of the laminated layers by a pressing operation.

As illustrated in FIG. 6, each of the sidewalls 30 is also provided with holes 31 that are positioned in alignment with holes 41 in the laminated pad. Refer also to FIG. 4 for an illustration of the position of the holes 31 and 41. These holes in the pocket and in the resilient pad are for accommodating the securing bolts 40. The configuration of the securing bolts 40 is illustrated in FIGS. 4 and 6. FIG. 4 is a partial cross-sectional view illustrating the manner in which the bolt 40 passes through the sidewalls 30 and also through the resilient pad 34. The securing bolt 40 includes a head 42 that may be a hex head and a shaft 44 that is threaded near its distal end as illustrated at 46. The very distal end of the bolt 40 is provided with an end post 48 that is of slightly smaller diameter than the diameter of the main shaft of the bolt.

As illustrated in FIG. 4 the bolt 40 passes through one of the sidewalls 30, through the resilient pad 34 and is threaded at 46. The clamp bar 50 has internally threaded holes 51 for receiving the threaded part of each bolt. The end post 48 is adapted to fit within a hole in the opposite sidewall 30. The end post 48 is preferably not threaded and is provided with a slight loose fit in the unthreaded hole in the sidewall 30. The threading of the bolt 40 with the clamp plate 50 clamps the entire resilient pad within its pocket. This is clearly shown in FIG. 4 where the tightening of the bolts 40 causes the clamp bar 50 to be urged against the laminated layers 36.

One of the stable aspects of the present construction is the relationship between the grouser flange 20 as it relates to the location of the resilient pad 34. In this regard refer to FIG. 8 which shows the grouser flanges 20 and, in dotted outline, the position of the resilient pad 14. It is noted that the grouser flange 20 is disposed over the resilient pad (in FIGS. 1 and 2). In other words the flange is constructed and arranged over the footprint 15 of the resilient pad as represented in FIG. 8 by the dotted outline of the pad 14. The grouser flange 20 is disposed, in the longitudinal direction of the resilient pad, near the center of the resilient pad but offset just slightly. In FIG. 8 the grouser flange 20 is approximately at a position one-third of the width of the resilient pad.

By placing the flange 20 within the footprint 15 the loading of the pad is more effectively transferred to the pin 10. The pin 10 could also be lengthened to bring the flanges 20 closer to or at the center of the footprint, however, the longer the pin, it tends to cantilever out from the arm more and possibly become overloaded. The flange position relative to the resilient pad footprint is preferably within the center 80% of the footprint as illustrated in FIG. 8. Refer also to FIG. 3 for an illustration of the relationship between the flanges 20 and the pad footprint 15. This transfers the load more directly to the mounting pin 10. As can also be seen from FIGS. 1, 6 and 8, each grouser flange 20 extends substantially the full length of each leg 14 and further includes a slightly turned end 20A, terminating at the cross base 16. These ends 20A provide some additional strengthening of the pad structure.

Another feature relating to the stability of the pad construction of the present invention is illustrated in FIG. 2 wherein it is noted that, regarding the elongated dimension of the resilient pad, the resilient pad 34 is disposed so that the pin 10 is approximately at the center thereof. Refer to the center line 11 in FIG. 2. This provided for a stable centering and proper force transfer from the stabilizer arm to the pad. The pin is located preferably within the center 40% of the longitudinal length of the resilient pad 34.

Another feature of the design of the present invention is that the complete stabilizer pad construction can be made lighter, and yet without compromising the strength and effectiveness of the design. This lighter, simplified construction requires less material and far fewer manufacturing operations than previous designs. Particularly, there is far less need of separate welding operations. For example, the thickness of the main plate material need only be about ⅜ inch thick. Part of the reason as to why the pad can be made lighter relates to the way in which the pin 10 is bolted with the weldment so as to absorb load transfer. In this way some of the twisting/pivoting forces on legs 14 are transfered onto/through the pin 10 making for a very robust construction. When the earth-moving equipment is working on uneven surfaces these legs 14 tend to have a scissoring motion about pin 10 independently of each other. This motion transfers through the base 16 onto the pin 10 which resists this rotation through its connections at each end through bolt 27, bushing 26, grouser flanges 20, legs 14 and base 16, thus essentially unifying both legs 14.

Another attribute allowing the utilization of lighter construction materials is the more symmetrical location of the grouser points 25 over the resilient pad 34, and relative to the pin 10. Refer to the side view of FIG. 2 showing that relationship with the pin 10 disposed between the grouser points 25. This lessens the rotational forces placed upon the supporting weldment about an axis that is parallel to the long axis of the laminated rubber pocket 32.

Figure 7:
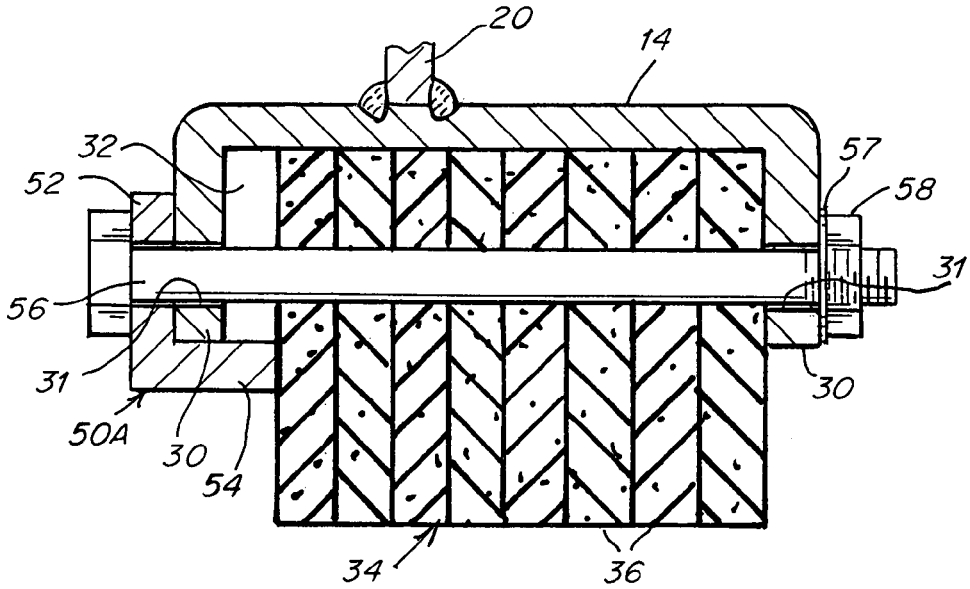
FIG. 7 is a fragmentary cross-sectional view like that shown in FIG. 4 but with an alternate clamping arrangement.

Reference is now made to an alternate arrangement shown in FIG. 7 for securing the resilient pad in place in its accommodating pocket. This uses a separate angle bracket 50A that has arms 52 and 54. The bracket 50A is mounted on the outside of the pocket thus making for a somewhat more compact arrangement. Arm 52 is shown against the sidewall 30 while the free end of arm 54 is urged against the laminate layers 36 to compress and hold the pad in place. The bracket may be used without any clamp bar or may be used with a clamp bar. FIG. 7 also shows the bolt 56 with its head at the bracket end, but the bolt may also pass in the opposite direction. In FIG. 7 the outer sidewall 30 may have a smooth hole or an internally threaded hole 31 for receiving the end of the bolt 56. The bracket 50A may be disposed on either side of the pocket. Alternatively, the hole 31 may be non-threaded and a nut 58 and lock washer 57 may be used to clamp the laminated layers in place, as shown in FIG. 7.

Having now described some embodiments of the present invention it should be apparent to those skilled in the art that other embodiments and modifications thereof are contemplated as falling within the scope of the present invention. For example, a two-sided pad has been described herein including both grouser and resilient pad sides. However, certain aspects of the present invention can also be practiced with a one-sided pad in which only the resilient pad is used and the pad is not reversible between sides.

What is claimed is:

1. A stabilizer pad structure comprising:

a weldment formed of a metal plate material that is arranged in a generally U-shaped form including side legs and a connecting base;

a pair of resilient pads mounted to said weldment;

means forming pockets in the respective legs of said weldment for receiving said resilient pads;

each said pocket including opposed sidewalls;

a clamp bar disposed between one side of said resilient pad and one of said side legs;

and at least one securing bolt having a head end, an intermediate threaded section and a distal end post;

said securing bolt constructed and arranged for passage through a hole in the resilient pad and through aligned holes in the opposed sidewalls defining the pocket;

said clamp bar having a threaded hole for engagement by the intermediate threaded section of the securing bolt to clamp the resilient pad in the pocket;

said head end for engagement with one of said opposed sidewalls and said distal post for engagement with the aligned hole in the other of the opposed sidewalls.

2. The stabilizer pad structure of claim 1 wherein the end post is unthreaded.

3. The stabilizer pad structure of claim 2 wherein the aligned hole in the other of the opposed sidewalls is unthreaded.

4. A stabilizer pad structure comprising:

a weldment formed of a metal plate material that is arranged in a generally U-shaped form including side legs and a connecting base;

a pair of resilient pads mounted to said weldment; and means forming pockets in the respective legs of said weldment for receiving said respective resilient pad;

wherein saidpockets are formed by bending said plate material on either side of each leg to form parallel disposed side wings;

a securing bolt for securing the resilient pad in the pocket;

a clamping bar disposed between one side of said resilient pad and one of said side wings;

wherein the securing bolt has a head end, an intermediate threaded section and a distal end post;

said securing bolt constructed and arranged for passage through a hole in the resilient pad and through aligned holes in the opposed sidewalls defining the pocket;

said clamp bar having a threaded hole for engagement by the intermediate threaded section of the securing bolt to clamp the resilient pad in the pocket;

said head end for engagement with one of said opposed sidewalls and said distal post for engagement with the aligned hole in the other of the opposed sidewalls.

* * * * *